US007104000B2

(12) United States Patent
Orth

(10) Patent No.: US 7,104,000 B2
(45) Date of Patent: Sep. 12, 2006

(54) RIFLE COMPRISING A STOCK AND A HOUSING WITH A HOUSING SHEATH

(75) Inventor: Manfred Orth, Heckenweg 18, D-34246 Vellmar (DE)

(73) Assignees: Manfred Orth, Vellmar (DE); Wilhelm Goddek, Lohfelden (DE); Josef Beer, Kempten (DE)

( * ) Notice: Subject to any disclaimer, the term of this patent is extended or adjusted under 35 U.S.C. 154(b) by 0 days.

(21) Appl. No.: 10/658,835

(22) Filed: Sep. 2, 2003

(65) Prior Publication Data

US 2005/0188584 A1 Sep. 1, 2005

(30) Foreign Application Priority Data

Sep. 10, 2002 (DE) ..... 102 41 764

(51) Int. Cl.
*F41C 23/00* (2006.01)

(52) U.S. Cl. ..... 42/71.01; 42/75.02

(58) Field of Classification Search ..... 42/75.02, 42/71.01

See application file for complete search history.

(56) References Cited

U.S. PATENT DOCUMENTS

| | | | | |
|---|---|---|---|---|
| 529,455 | A * | 11/1894 | Marlin | 42/75.02 |
| 618,033 | A * | 1/1899 | Hemming | 42/75.02 |
| 1,163,156 | A * | 12/1915 | Johnson | 42/75.02 |
| 2,437,137 | A | 3/1948 | Swebilius | |
| 3,731,418 | A | 5/1973 | Birkenhagen et al. | |
| 4,103,586 | A | 8/1978 | Tollinger | |
| 4,388,773 | A | 6/1983 | Beretta | |
| 4,519,156 | A | 5/1985 | Shaw | |
| 4,541,192 | A | 9/1985 | Flodman et al. | |
| 4,648,191 | A | 3/1987 | Goff et al. | |
| 4,729,186 | A | 3/1988 | Rieger | |
| 5,020,260 | A | 6/1991 | Houghton | |
| 5,247,758 | A | 9/1993 | Mason | |
| 5,311,692 | A | 5/1994 | Blaser | |
| 5,410,834 | A | 5/1995 | Benton et al. | |
| 5,454,182 | A | 10/1995 | Lewis et al. | |
| 5,540,008 | A | 7/1996 | Kirnstaetter | |
| 5,813,158 | A | 9/1998 | Campbell et al. | |
| 6,293,040 | B1 | 9/2001 | Luth | |
| 6,415,701 | B1 | 7/2002 | Dobbins | |
| 6,470,616 | B1 | 10/2002 | Clay | |
| 6,470,617 | B1 | 10/2002 | Gregory et al. | |

FOREIGN PATENT DOCUMENTS

| | | |
|---|---|---|
| DE | 198 15 261 | 12/1999 |
| DE | 102 05 503 | 2/2002 |
| EP | 0 423 677 | 4/1991 |

(Continued)

OTHER PUBLICATIONS

U.S. Serial No. 10/351,704, filed Jan. 27, 2003, Orth.
Sauer 202.

*Primary Examiner*—M. Clement
(74) *Attorney, Agent, or Firm*—Jordan and Hamburg LLP

(57) ABSTRACT

A rifle, comprising a stock with a housing provided with a housing sheath and a barrel, the barrel having a barrel sleeve adapted to be removably received by the housing sheath of the housing of the stock, the housing sheath being provided with a slot extending longitudinally along said housing sheath, the housing sheath having parts for varying the slot width in the region of the slot, the diameter of the housing sheath being adjustable to the diameter of the barrel sleeve using the parts for varying the slot width, the barrel sleeve of the barrel being positively lockable with the housing sheath.

6 Claims, 4 Drawing Sheets

FOREIGN PATENT DOCUMENTS

| | | |
|---|---|---|
| FR | 2 810 104 | 12/2001 |
| GB | 187078 | 10/1922 |
| GB | 2 178 832 | 2/1987 |

* cited by examiner

RIFLE COMPRISING A STOCK AND A HOUSING WITH A HOUSING SHEATH

BACKGROUND OF THE INVENTION

1. Field of the Invention

The present invention relates to a rifle comprising a stock with a housing provided with a housing sheath and a barrel, the barrel having a barrel sleeve adapted to be removably received by the housing sheath of the stock housing, said housing sheath being provided with a slot extending longitudinally along said housing sheath, said housing sheath comprising means for varying the slot width in the region of the slot.

Experts use the term "takedown rifle" when speaking of a rifle the barrel of which is detachable from the stock. Such type rifles, the barrel of which may be separated from the stock, are particularly suited for use when a rifle must be transported or when the barrel is wished to be interchangeable.

2. Description of the Prior Art

In a prior art takedown rifle (SAUER 202), the barrel is clampingly received by the housing sheath of the stock housing. For this purpose the housing has a lengthwise slotted sheath-like projection which is provided with clamping screws in the region of the slot. Said clamping screws serve to vary the width of the slot so that the barrel may be clampingly fastened in the slotted sheath-like projection of the housing. The disadvantage of this rifle is that after each assembly the barrel adopts another position relative to the stock so that the aiming situation is a different one after each assembly as a result thereof. This is substantially due to the fact that the barrel of the rifle is oriented relative to the stock in function of the tightening torque of the various clamping screws.

DE 198 15 261 C2 describes a rifle that can disassemble into three parts and the barrel of which is fastened to the stock through the forearm. Beneath the stock housing, the stock is thereby provided with a groove that opens toward the front side of the stock. A corresponding nose of the barrel is insertable into said groove. The groove is closed by the front side of the forearm so that the barrel is fastened to the stock through the forearm. The forearm is fastened to the stock by way of a dovetail guide that is oriented normal to the longitudinal axis of the barrel on the front side between forearm and stock. In order to prevent the forearm from unintentionally detaching from the stock there is provided a locking device in the form of a movable pin, the movement of the forearm relative to the stock being blocked by said pin. The movable pin communicates with a lever provided on the forearm, the pin being capable of being snapped into engagement with the stock or of being disengaged from this position of engagement through said lever.

It is not necessary to lock the barrel to the stock during firing since, in the repeated condition, the barrel is connected with form-positive fit to the housing and, as a result thereof, to the stock, through the chamber body. Accordingly, the barrel needs only be fastened to the stock through the forearm in the non-repeated condition i.e., during repetition because during repetition there is a risk that the chamber body or the cartridge inserted in the chamber pulls the barrel forward and out.

This known rifle is characterized inter alia in that it offers the same aiming situation at each shot regardless of how often it has been assembled and disassembled. The reason therefore is that the barrel is not clamped to the housing of the stock as it is the case with prior art rifles in which the barrel is clampingly fixed through the screws to the housing of the stock.

However, to lock the forearm to the stock is a quite complicated operation. A rifle is known (DE 102 05 503), which is comprised of a stock, a forearm and a barrel, the barrel being also releasably connectable to the stock. A locking device is provided for locking the forearm to the stock. The locking device more specifically comprises a rod with a piston disposed on the end thereof, said rod extending through the forearm. The piston is lodged in a bore of the stock and is spring-loaded. Circumferentially spaced locking members which are configured as balls are located on the piston. A forearm bushing, which has circumferentially spaced openings for the balls, projects into the bore of the stock. A tangentially oriented groove is located in the bore of the stock, in the same plane as the bushing openings. The piston causes the balls to enter the openings in the bushing, said balls concurrently projecting into the circumferential groove. The piston and the balls thus provide a form-positive fit between the forearm with the barrel and the stock.

BRIEF SUMMARY OF THE INVENTION

The subject matter of the present invention also is a rifle with a take-down barrel that permits very easy assembly/disassembly of the rifle, the entire construction of which with regard to the locking of the barrel to the stock being simple and affordable and with the process tolerances between the outside diameter of the barrel sleeve on the one side and the diameter of the housing sheath on the other side being intended to be compensated for.

In accordance with the invention, a rifle of the type mentioned herein above that meets these requirements is characterized in that the diameter of the housing sheath is adjustable to the diameter of the barrel sleeve using the means for varying the slot width, the barrel sleeve being positively lockable with the housing sheath. In contrast to prior art rifles the barrel of which is clampingly receivable by the housing, the lock provided in the present case is positive. The variability of the slot width only serves to adjust the inside diameter of the housing sheath to the outside diameter of the barrel sleeve or to adapt it thereto for the purpose of minimizing any potential clearance between the barrel sleeve and the housing sheath.

More specifically there is provided that the means for varying the slot width of the housing sheath are comprised of at least one screw that spans the slot and is adapted to be tension-biased and of at least one screw that expands the slot, a screw that expands the slot being advantageously disposed along the slot between at least two screws that are adapted to be tension-biased. In disposing an expansion screw, meaning a pressure biased screw, between two tension screws causing the two ends of the housing sheath forming the slot to be pulled together, it is now possible to adjust the inside diameter of the housing sheath exactly to the outside diameter of the barrel sleeve by varying the slot width so that the housing sheath accommodates the barrel sleeve with substantially zero clearance without said barrel sleeve being secured to the housing sheath by a clamping connection. Using screws acting in opposite directions, the ones being tension biased and the other pressure biased, said screws are braced so that the once adjusted diameter is reliably maintained. More specifically, it is also achieved that the housing sheath is adjustable to the same diameter over its entire length by disposing the compression screw between the two tension biased screws.

According to another feature of the invention, a latch with a latch head is provided for locking the barrel sleeve to the housing sheath, said latch being slidably carried across the longitudinal axis of the housing in the housing sheath and the latch head being insertable in a mating recess in the barrel sleeve. Said latch, which actually is also slidably carried in the stock, is push-button actuatable from the outside, with the latch head advantageously being adapted to be urged out of the recess in the barrel sleeve against the bias of a spring. It will be obvious therefrom that without the latch being actuated the latch head will always remain in engagement with the barrel sleeve because of the spring bias of the latch so that the barrel is prevented from unintentionally detaching from the stock. The recess is advantageously disposed on the circumference of the barrel sleeve, the recess being configured as a mere notch on the circumference of the barrel sleeve. As a result thereof, the barrel sleeve is minimally weakened.

In order to facilitate assembly of the barrel to the stock, there is provided, in accordance with a particular feature of the invention, that the latch head be slanted in the direction of insertion of the barrel. This means that it is not necessary to actuate the latch in order to lock the barrel to the stock housing as the barrel sleeve causes the latch head to be pushed back by the slanted side thereof, the spring loaded latch head engaging automatically into the recess once the barrel has reached the end position within the housing.

In accordance with another feature of the invention there is provided a bolt guidance between the stock and the forearm. More specifically, such a bolt guidance consists in that the forearm is provided with a bolt that extends parallel to the longitudinal axis of the barrel, said bolt being receivable by a corresponding bore in the stock. This bolt guidance stabilizes the barrel inasmuch as it is capable of taking part of the forces and torques generated by transverse forces acting onto the barrel. Furthermore, the bolt guidance also serves to facilitate assembly by providing a guidance while the forearm with the barrel is being introduced into the housing.

The invention will be understood better upon reading the exemplary description accompanying the drawing.

DETAILED DESCRIPTION OF THE INVENTION

Figure 1:
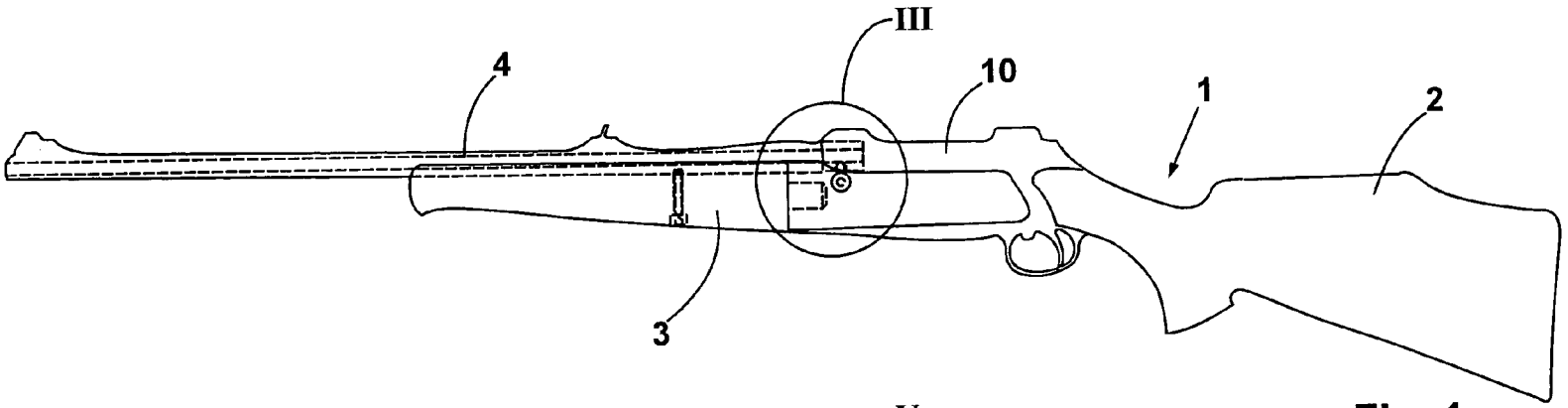
FIG. 1 shows the rifle in its assembled condition.
Figure 2:
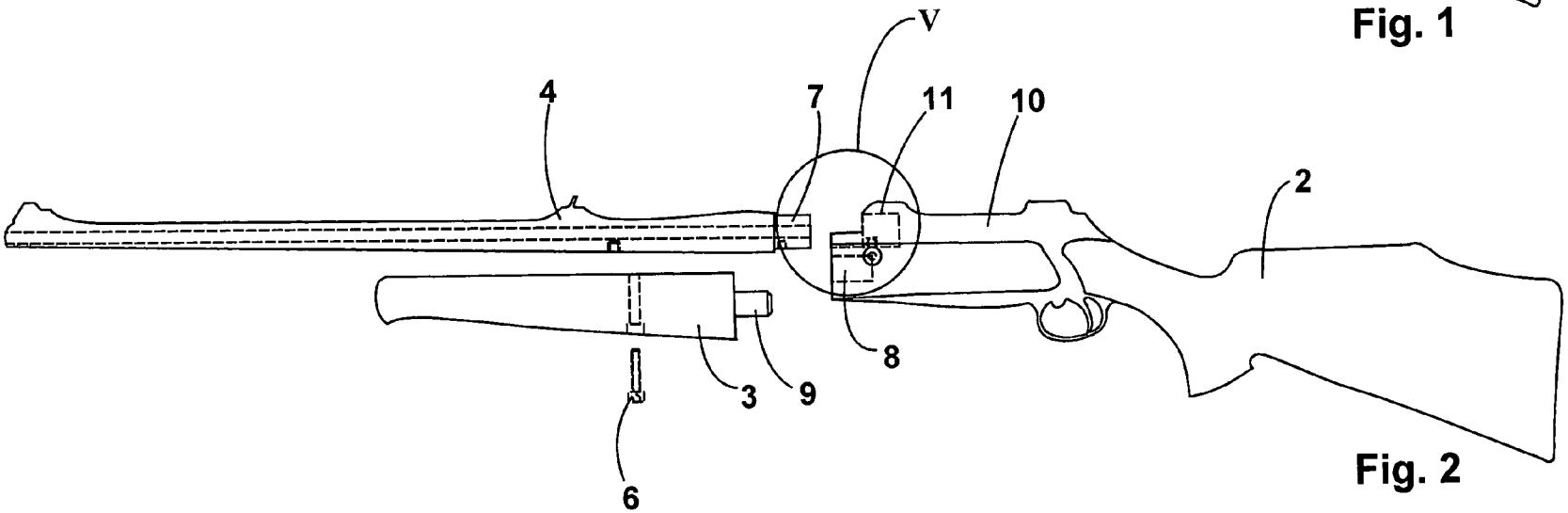
FIG. 2 shows the rifle with the barrel having been taken down and also how the forearm is fastened to the barrel.

According to the FIGS. 1 and 2, the rifle, which is indicated generally at 1, is comprised of a stock 2, a forearm 3, a barrel 4 and a housing 10. On its side facing the barrel, the housing 10 comprises what is termed herein the housing sheath 11, the barrel, which is indicated at 4, comprising a corresponding barrel sleeve 7 that is slidably receivable by housing sheath 11. The stock, which is indicated generally at 2, has a bore 8 for receiving the bolt 9 of the forearm 3. The forearm is attached to the barrel 4 through the screw 6. The screw attachment should thereby be performed as nearly as practicable to the barrel sleeve 7 since, if the barrel happens to expand longitudinally under the action of heat, a possible torsion of the barrel 4 relative to the forearm is the lower, the nearer the point of attachment of the forearm to the barrel is located on the barrel sleeve 7, meaning the site that is subjected to the highest heat loads in the event of a plurality of consecutive shots being fired.

Figure 3:
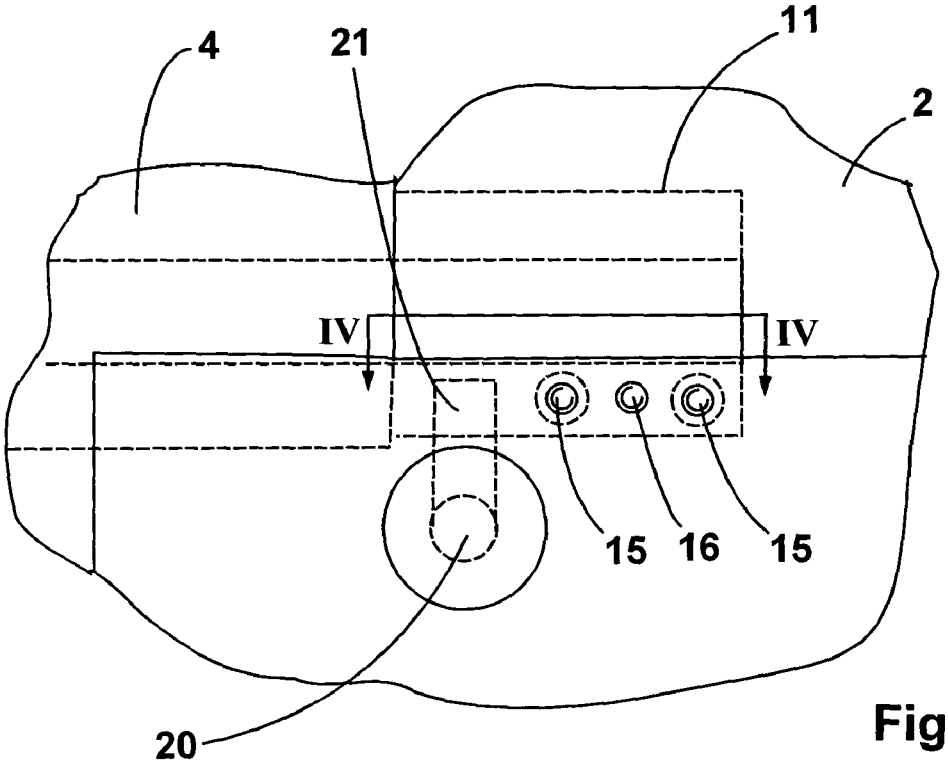
FIG. 3 shows detail III of FIG. 1 on an enlarged scale.

The housing sheath 11 comprises the slot, which is indicated generally at 12. The two ends 11*a* and 11*b* of the housing sheath 11 are pulled together by the two screws 15, illustrated as first and third screws of three adjacent screws in FIG. 3. The two screws 15 are disposed parallel to the longitudinal axis of the slot. Moreover, there is the expansion screw 16, illustrated as a second screw in the three adjacent screws in FIG. 3. The expansion screw 16 is configured in the form of a stud screw, that is accommodated in the one portion of the housing sheath 11 and causes the slot to expand. Once the width of the slot 12 is adjusted, the screws 15 and 16 can be braced so as to fix the width of the slot. The screws 15 and 16 defining means for varying the slot width in the region of the slot 12 so that the diameter of the housing sheath adjusts to the diameter of the barrel sleeve. Furthermore, adjusting the expansion screw 16 tension biases the first two screws 15.

In the event that interchangeable barrels are being utilized, this more specifically permits to accurately adjust the diameter of the housing sheath to the diameter of the respective one of the barrel sleeves of the interchangeable barrel.

Figure 4:
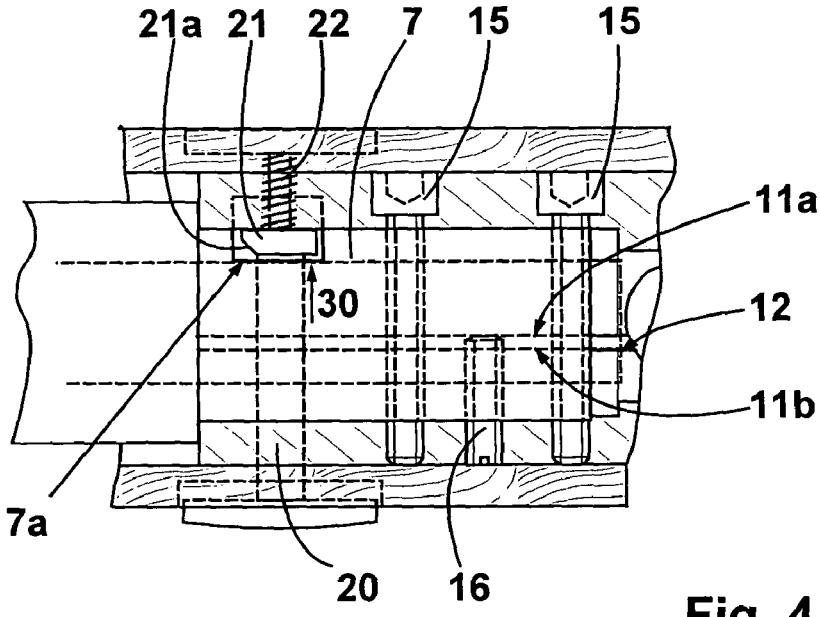
FIG. 4 shows a section along line IV/IV FIG. 3.
Figure 5:
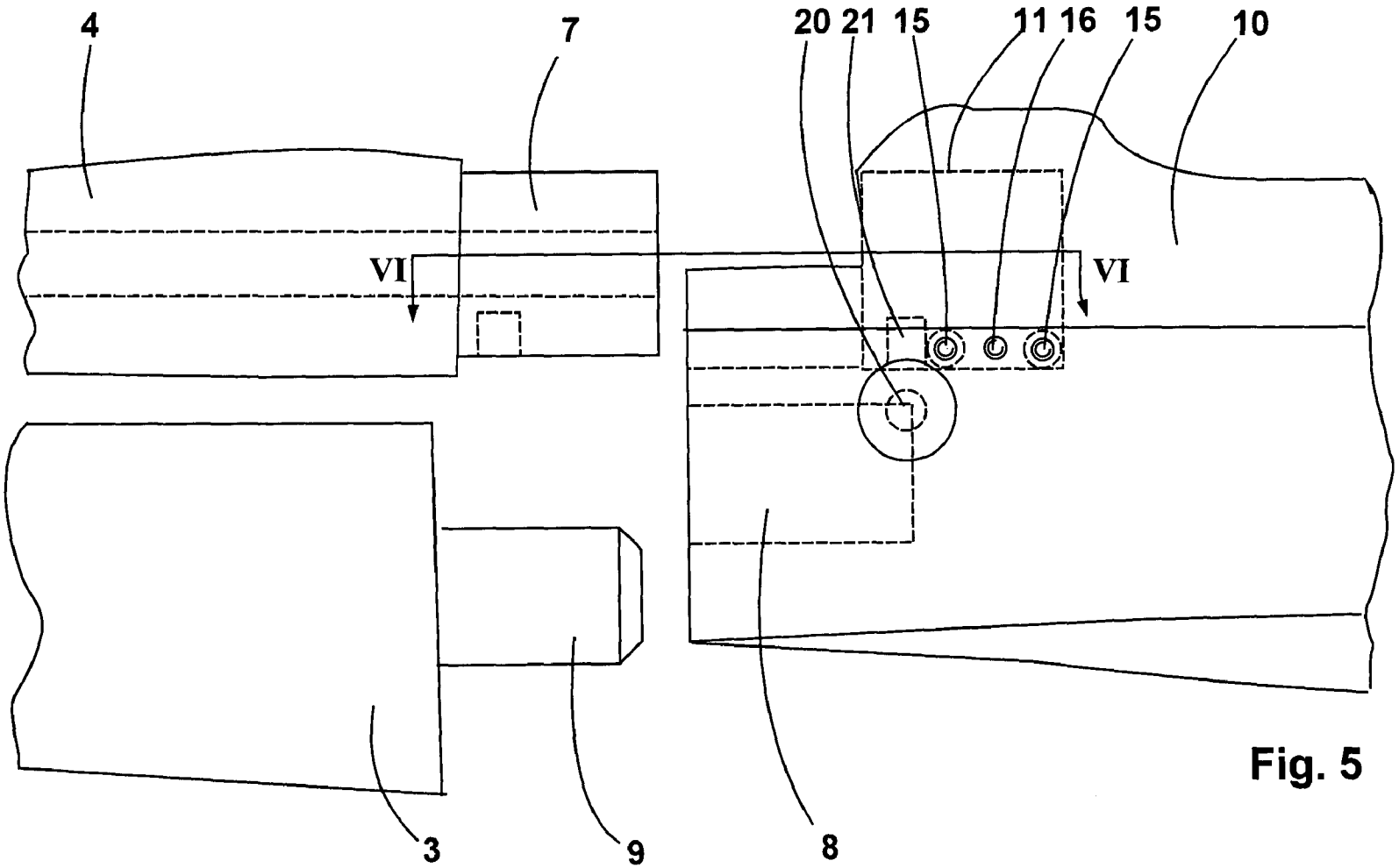
FIG. 5 shows detail V on an enlarged scale.
Figure 6:
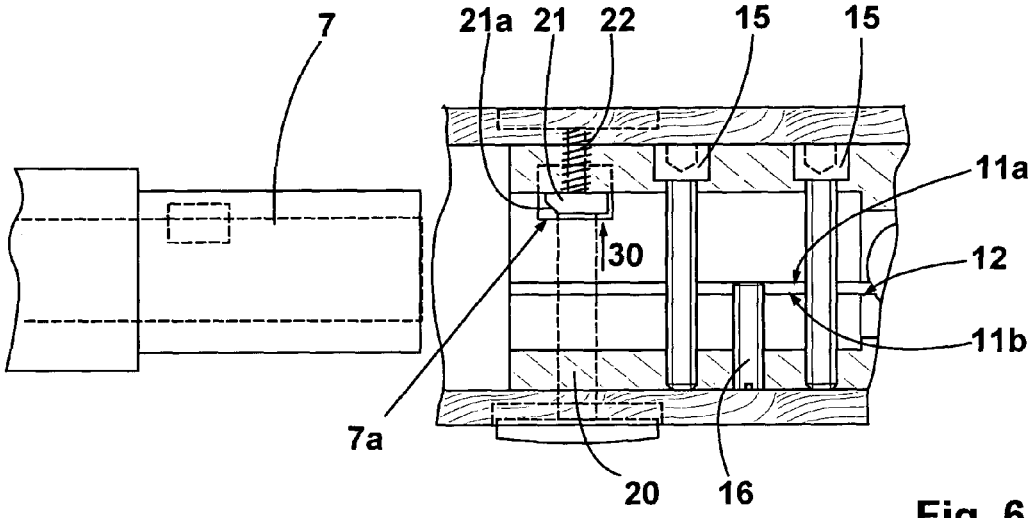
FIG. 6 shows a section along line VI/VI FIG. 5.

To lock the barrel sleeve 7 in the housing sheath 11, there is provided the latch, which is indicated at 20. The latch 20 is comprised of the latch head 21 which is insertable into a mating recess 7*a* provided in the barrel sleeve. The latch 20 is subjected to the load of the spring 22; this means that, if the latch 20 is urged in the direction of the arrow 30 against the bias of the spring 22, the latch head 21 is allowed to disengage the recess 7*a* so that the barrel with the barrel sleeve 7 can be removed from the housing sleeve 11. Thanks to the slant 21*a* at the latch head the barrel sleeve merely needs to be inserted into the housing sleeve during assembly of the barrel, said slant 21*a* on the latch head permitting the latch to be automatically displaced in the direction of arrow 30 before it recovers the position according to FIG. 4 once the barrel sleeve 7 has been nested within the housing sheath.

We claim:

1. A rifle, comprising:

a stock, said stock including a housing, said housing including a housing sheath;

a barrel, said barrel including a barrel sleeve, said barrel sleeve removably connecting to the housing sheath;

said housing sheath including a slot, said slot extending longitudinally along said housing sheath;

said housing sheath further comprising means for varying the slot width so that the diameter of the housing sheath adjusts to the diameter of the barrel sleeve;

the barrel sleeve being lockable with the housing sheath;

a latch and a recess disposed in said barrel sleeve for receiving said latch;

the recess being disposed on the circumference of the barrel sleeve; and said latch including a latch head for locking the barrel sleeve to the housing sheath, said latch being slidable across the longitudinal axis of the housing sheath and said latch head being insertable in said recess in the barrel sleeve.

2. A rifle, comprising:

a stock, said stock including a housing, said housing including housing sheath;

a barrel, said barrel including a barrel sleeve, said barrel sleeve removably connecting to the housing sheath;

said housing sheath including a slot, said slot extending longitudinally along said housing sheath;

said housing sheath further comprising means for varying the slot width so that the diameter of the housing sheath adjusts to the diameter of the barrel sleeve;

the barrel sleeve being lockable with the housing sheath;

a latch and a recess in said barrel sleeve for receiving said latch;

said latch including a latch head for locking the barrel sleeve to the housing sheath, said latch being slidable across the longitudinal axis of the housing sheath and said latch head being insertable in said recess in the barrel sleeve; and the latch head being adapted for disengaging the recess against the bias of a spring.

3. A rifle, comprising:

a stock, said stock including a housing, said housing including a housing sheath;

a barrel, said barrel including a barrel sleeve, said barrel sleeve removably connecting to the housing sheath;

said housing sheath including a slot, said slot extending longitudinally along said housing sheath;

said housing sheath further comprising means for varying the slot width so that the diameter of the housing sheath adjusts to the diameter of the barrel sleeve;

the barrel sleeve being lockable with the housing sheath;

a latch and a recess in said barrel sleeve for receiving said latch;

said latch including a latch head for locking the barrel sleeve to the housing sheath, said latch being slidable across the longitudinal axis of the housing sheath and said latch head being insertable in said recess in the barrel sleeve; and the latch head having a slant, said slant being disposed in the direction of insertion of the barrel into the housing.

4. A rifle, comprising:

a stock, said stock including a housing, said housing including a housing sheath;

a barrel, said barrel including a barrel sleeve, said barrel sleeve removably connecting to the housing sheath;

said housing sheath including a slot, said slot extending longitudinally along said housing sheath;

said housing sheath further comprising means for varying the slot width so that the diameter of the housing sheath adjusts to the diameter of the barrel sleeve;

the barrel sleeve being lockable with the housing sheath;

the barrel having a forearm, the forearm being fastened to the barrel; and a bolt guidance being disposed between the forearm and the stock.

5. A rifle comprising:

a stock, said stock including a housing, said housing including a housing sheath;

a barrel, said barrel including a barrel sleeve, said barrel sleeve removably connecting to the housing sheath;

said housing sheath including a slot, said slot extending longitudinally along said housing sheath;

said housing sheath further comprising means for varying the slot width so that the diameter of the housing sheath adjusts to the diameter of the barrel sleeve;

the barrel sleeve being lockable with the housing sheath;

the rifle further comprising a latch and a recess in the barrel sleeve for receiving the latch, the latch having a latch head for locking the sleeve of the barrel to the housing sheath, the latch being slidable across the longitudinal axis of the housing sheath; and the recess being disposed on the circumference of the barrel sleeve.

6. A rifle comprising:

a stock, said stock including a housing, said housing including a housing sheath, a barrel, said barrel including a barrel sleeve, said barrel sleeve removably connecting to the housing sheath;

said housing sheath including a slot, said slot extending longitudinally along said housing sheath;

said housing sheath further comprising means for varying the slot width so that the diameter of the housing sheath adjusts to the diameter of the barrel sleeve;

the barrel sleeve being lockable with the housing sheath, the barrel having a forearm, the forearm being fastened to the barrel; and the rifle further comprising a bolt guidance between the forearm and the stock.

* * * * *